US010405662B2

(12) United States Patent
Cohen

(10) Patent No.: US 10,405,662 B2
(45) Date of Patent: Sep. 10, 2019

(54) FOLDING X-FRAME CHAIR WITH EXTENDED BACKREST

(71) Applicant: Rio Brands, LLC, Philadelphia, PA (US)

(72) Inventor: Warren Cohen, Philadelphia, PA (US)

(73) Assignee: Rio Brands, LLC, Philadelphia, PA (US)

( * ) Notice: Subject to any disclaimer, the term of this patent is extended or adjusted under 35 U.S.C. 154(b) by 0 days.

(21) Appl. No.: 15/447,803

(22) Filed: Mar. 2, 2017

(65) Prior Publication Data

US 2018/0249837 A1 Sep. 6, 2018

(51) Int. Cl.
*A47C 4/48* (2006.01)
*A47C 4/28* (2006.01)

(52) U.S. Cl.
CPC . *A47C 4/28* (2013.01); *A47C 4/48* (2013.01)

(58) Field of Classification Search
CPC ..... A61G 5/006
See application file for complete search history.

(56) References Cited

U.S. PATENT DOCUMENTS 37,324 A * 1/1863 Merriam ..... A47C 4/24 297/56
38,132 A * 4/1863 Vaill ..... A47C 4/14 297/52
108,973 A * 11/1870 Comins ..... A47C 1/0265 297/28
534,501 A * 2/1895 Evers ..... A47C 4/40 297/23
631,176 A * 8/1899 Pinnock ..... A47C 4/16 297/26
912,216 A * 2/1909 Wells ..... A47C 4/40 297/131
1,440,248 A * 12/1922 Shoemaker ..... A47C 4/42 297/51
1,539,225 A * 5/1925 West ..... A47C 3/025 297/18
1,601,043 A * 9/1926 Schneider ..... A47C 4/40 297/23
1,696,966 A * 1/1929 Nicholson ..... A47C 4/40 297/18
1,728,849 A * 9/1929 Bailly ..... A47C 4/40 248/164
1,885,269 A * 11/1932 Kraner ..... A47C 4/30 297/51
1,948,387 A * 2/1934 Levy ..... A47C 4/38 297/126

(Continued)

*Primary Examiner* — Kyle J. Walraed-Sullivan
(74) *Attorney, Agent, or Firm* — LaMorte & Associates, P.C.

(57) ABSTRACT

A folding chair assembly having a seat framework and a backrest framework arranged in an X-frame arrangement. The backrest framework is joined to the seat framework at pivot joints. The seat framework and the backrest framework can move about the pivot joints between an open configuration and a folded configuration. Frame extensions are provided that are joined to the backrest frame with hinge joints. The hinge joints enable the frame extensions to be folded about the hinge joints between a first position, where said frame extensions abut against the backrest framework, and a second position, where the frame extensions extend away from the backrest framework and increase its effective length.

10 Claims, 9 Drawing Sheets

(56) References Cited

U.S. PATENT DOCUMENTS 1,949,282 A * 2/1934 Murray ..... A47C 4/38 297/18
1,952,610 A * 3/1934 Shearer ..... A47C 4/40 248/188.91
1,969,313 A * 8/1934 Meeker ..... A47C 4/40 297/17
1,975,689 A * 10/1934 Hall ..... A47C 4/40 297/18
2,052,955 A * 9/1936 Vanderminden ..... A47C 4/40 297/23
2,080,761 A * 5/1937 Crawford ..... A47C 4/30 160/404
2,096,169 A * 10/1937 Friesner ..... A47C 4/50 297/23
D149,845 S * 6/1948 Sebel ..... 297/447.2
2,567,341 A * 9/1951 Martin ..... A47C 4/40 297/18
D167,593 S * 8/1952 Shepard ..... 297/452.17
2,660,224 A * 11/1953 Frisch ..... A47C 4/40 297/130
2,664,940 A * 1/1954 High ..... A47C 4/40 182/33
2,697,476 A * 12/1954 Tripodi ..... A47C 4/30 297/18
2,708,960 A * 5/1955 Shephard ..... A47C 4/50 297/18
2,713,890 A * 7/1955 Mack ..... A47C 4/50 297/31
2,741,298 A * 4/1956 Roberts, III ..... A47C 4/40 297/18
2,757,716 A * 8/1956 Moore ..... A47C 4/48 297/40
2,820,509 A * 1/1958 Moreland ..... A47C 4/48 16/275
3,112,953 A * 12/1963 Raver ..... A47C 4/40 297/18
3,220,764 A * 11/1965 Duer ..... A47C 4/24 108/120
3,228,724 A * 1/1966 Resar ..... A47C 4/46 297/378.12
3,338,625 A * 8/1967 Chang ..... A47C 4/50 297/18
3,453,022 A * 7/1969 Lecuyer ..... A47C 4/24 297/46
3,485,526 A * 12/1969 Olitzky ..... A47C 4/04 297/31
D220,908 S * 6/1971 Smith ..... D6/368
3,621,192 A * 11/1971 Pohler ..... A47C 7/748 219/217
3,779,655 A * 12/1973 Toyota ..... A47C 1/026 403/93
3,845,984 A * 11/1974 Rowland ..... A47C 4/24 297/331
3,851,915 A * 12/1974 Rodrigo ..... A47C 4/24 108/119
D248,344 S * 7/1978 Uchida ..... D6/368
D252,428 S * 7/1979 Brelsford ..... D6/367
4,164,354 A * 8/1979 Rodaway ..... A61G 5/08 280/42
D256,300 S * 8/1980 Yoshimura ..... D6/368
4,241,950 A * 12/1980 Simpson ..... A47C 4/24 297/18
4,252,367 A * 2/1981 Vanderminden ..... A47C 4/40 297/23
4,273,379 A * 6/1981 Borichevsky ..... A47C 4/02 297/440.11
4,415,177 A * 11/1983 Hale ..... A47C 4/42 280/650
4,415,201 A * 11/1983 Wang ..... A47C 4/24 297/283.1
4,482,186 A * 11/1984 Gomes ..... A47C 4/40 16/379
4,541,666 A * 9/1985 Vanderminden ..... A47C 1/14 297/16.1
4,583,778 A * 4/1986 Liebhold ..... A47C 4/025 297/440.11
4,597,604 A * 7/1986 Singer ..... A47C 4/14 297/18
4,684,278 A * 8/1987 Rauschenberger ..... A47C 4/20 16/365
4,889,383 A * 12/1989 Jones ..... A47C 4/02 297/16.1
5,054,849 A * 10/1991 Hoff ..... A47C 4/286 297/440.11
5,058,948 A * 10/1991 Singer ..... A47C 4/24 297/18
5,169,257 A * 12/1992 Liou ..... A47C 20/045 16/333
5,213,360 A * 5/1993 Lin ..... A47D 1/02 280/30
5,303,975 A * 4/1994 Asato ..... A45F 4/02 224/155
D360,082 S * 7/1995 Tseng ..... D6/368
5,470,039 A * 11/1995 Hilger ..... A47D 5/006 248/164
5,476,308 A * 12/1995 St. Germain ..... A47C 5/06 297/229
5,507,548 A * 4/1996 Marhefka ..... A47C 4/283 297/45
5,547,246 A * 8/1996 Lambert ..... A47C 13/00 224/153
D374,780 S * 10/1996 Tseng ..... D6/375
5,590,933 A * 1/1997 Andersson ..... B60N 2/874 297/408
5,725,281 A * 3/1998 Vairinen ..... A47C 1/03 297/423.26
D395,763 S * 7/1998 Machell ..... D6/344
5,927,798 A * 7/1999 Ahn ..... A45C 15/00 297/129
5,971,474 A * 10/1999 Chang ..... A47C 4/50 297/41
6,012,769 A * 1/2000 Hsueh ..... A47C 3/16 297/19
6,048,023 A * 4/2000 Lampton ..... A45C 15/00 297/129
6,257,660 B1 * 7/2001 Calvey ..... A47C 3/029 297/16.1
6,547,324 B1 * 4/2003 Ammann, Jr. ..... A45F 4/02 224/155
6,752,452 B2 * 6/2004 Choi ..... A47C 4/286 297/16.2
6,789,809 B2 * 9/2004 Lin ..... B62B 1/12 280/47.18
6,789,848 B2 * 9/2004 Rauschenberger ..... A47C 1/026 297/354.12
6,817,661 B2 * 11/2004 Zheng ..... A47C 7/54 297/16.1
6,877,803 B1 * 4/2005 Reese ..... A47C 4/50 297/18
D505,558 S * 5/2005 Milinov ..... D6/335
6,923,416 B1 * 8/2005 Hsieh ..... F16M 11/38 108/118
7,350,856 B1 * 4/2008 Tseng ..... A47C 7/407 297/44
7,604,288 B1 * 10/2009 Verhulst ..... A45F 4/02 297/129
7,712,479 B2 * 5/2010 Sundarrao ..... A45B 7/00 135/74
D654,714 S * 2/2012 Tseng ..... D6/368
D667,648 S * 9/2012 Le Gal ..... D6/361
D675,841 S * 2/2013 Mound, II ..... D6/368
D706,049 S * 6/2014 Yang ..... D6/368
D707,050 S * 6/2014 Colby ..... D6/368
9,211,011 B2 * 12/2015 Hashida ..... A47C 1/026
D762,394 S * 8/2016 Hardesty ..... D6/368
9,604,660 B1 * 3/2017 Zuo ..... B62B 7/12
9,862,400 B2 * 1/2018 Valdez ..... B62B 7/062

(56) References Cited

U.S. PATENT DOCUMENTS

2002/0125744 A1* 9/2002 Tseng ..... A47C 4/14 297/16.1
2004/0066075 A1* 4/2004 Yeh ..... A47C 4/286 297/354.1
2005/0082884 A1* 4/2005 Yao ..... A47C 4/24 297/16.1
2005/0099039 A1* 5/2005 Rhee ..... A47C 4/48 297/129
2006/0071511 A1* 4/2006 Tseng ..... A47C 4/28 297/16.1
2007/0063550 A1* 3/2007 Lin ..... A47C 4/42 297/16.1
2007/0228780 A1* 10/2007 Grace ..... A47C 4/283 297/45
2007/0257524 A1* 11/2007 Huang ..... A47C 3/04 297/16.1
2007/0262102 A1* 11/2007 Rininger ..... A45F 4/02 224/155
2008/0012399 A1* 1/2008 Lin ..... A47C 4/283 297/188.08
2008/0042474 A1* 2/2008 Dickie ..... B62B 7/06 297/16.2
2008/0256747 A1* 10/2008 Chang ..... A47C 1/143 16/239
2008/0290698 A1* 11/2008 Lewis ..... A47C 4/28 297/16.1
2009/0315300 A1* 12/2009 Stiba ..... B62B 7/10 280/648
2010/0001555 A1* 1/2010 Chen ..... A47C 4/48 297/46
2010/0171342 A1* 7/2010 Chen ..... A47C 4/283 297/45
2011/0198893 A1* 8/2011 Leng ..... A47C 4/24 297/46
2012/0074737 A1* 3/2012 Huang ..... A47C 4/24 297/16.1
2015/0130246 A1* 5/2015 Hashida ..... A47C 1/027 297/376
2015/0230613 A1* 8/2015 Frankel ..... A47C 4/28 297/48
2015/0314798 A1* 11/2015 Valdez ..... B62B 7/062 280/642
2016/0081479 A1* 3/2016 Lin ..... A47C 4/04 297/16.1
2016/0206101 A1* 7/2016 Grace ..... A47C 4/283
2016/0338492 A1* 11/2016 Piretti ..... A47C 4/04
2017/0188697 A1* 7/2017 Lin ..... A47B 3/02
2018/0027970 A1* 2/2018 Frankel ..... A47C 4/48

* cited by examiner

FOLDING X-FRAME CHAIR WITH EXTENDED BACKREST

BACKGROUND OF THE INVENTION

1. Field of the Invention

In general, the present invention relates to the structure of portable folding chairs that fold flat for storage and to be carried from point to point. More particularly, the present invention relates to folding chairs configured as X-frame chairs and the elements within the chairs that enable the X-frame chair to be erected and collapsed.

2. Prior Art Description

Many people carry folding chairs to the beach, parks, and other outdoor destinations. Folding chairs are preferred because they fold into smaller shapes that can be more readily carried from point to point. Many folding chairs are even manufactured with carry straps or shoulder straps to make the chairs easier to carry. Folding chairs come in many shapes and styles. Typically, the folding chair has a simple small design. One of the simplest chair designs is the X-frame chair. In an X-frame chair, the front and rear legs are joined at pivots near their centers. This enables the legs to rotate into an "X" shape when open and into a single plane when closed. Such X-shaped frames are often used on portable beach chairs and deck chairs.

Regardless of the style of the folding chair, an X-frame folding chair typically folds by folding the backrest flush against the seat or vice versa. This makes the folding chair much thinner than when it is unfolded. However, the height of the chair, i.e. the length of the backrest frame from bottom to top, remains the same. This length is typically between twenty inches and forty inches, depending upon the size of the folding chair. Larger X-frame folding chairs, with backrest lengths of over thirty inches, are difficult to carry and store, even when the chair is folded. The long length of the folded chair makes it difficult to fit into the trunks and other storage areas of compact cars. The long length also makes the folded chairs difficult to carry using a shoulder strap, since the folded chair extends very far from the body.

A need exists for a folding X-shaped chair that is specifically designed to fold to a length that is shorter than its height. Such a folding chair needs to be lightweight and collapsible into a convenient size. It further needs to have lifting features that enable the chair to be comfortably carried for long distances. These needs are met by the present invention as described and claimed below.

SUMMARY OF THE INVENTION

The present invention is a folding chair assembly having a seat framework and a backrest framework arranged in an X-frame arrangement. The backrest framework is joined to the seat framework at pivot joints. The seat framework and the backrest framework can move about the pivot joints between an open configuration and a folded configuration.

The X-frame arrangement can be locked in an open configuration using a leg locking system, rigid armrest and/or armrest straps. Leg locks and rigid armrests mechanically lock the X-frame into an open configuration. Armrest straps, if provided, extend between the seat framework and the backrest framework. The armrest straps are taut in tension when the seat framework and the backrest framework are in their open configuration. The tension in the armrest straps is increased by the weight of a person sitting in the folding chair assembly.

Frame extensions are provided that are joined to the backrest framework with hinge joints. The hinge joints enable the frame extensions to be folded about the hinge joints between a first position, where said frame extensions abut against the backrest framework, and a second position, where the frame extensions extend away from the backrest framework and increase its effective length.

The folding chair assembly is completed with at least one foldable panel that is supported by the seat framework, the backrest framework and the extensions.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention folding chair can be embodied in many ways, only a few exemplary embodiments of the folding chair are illustrated. The exemplary embodiments are selected in order to set forth some of the best modes contemplated for the invention. The illustrated embodiments, however, are merely exemplary and should not be considered a limitation when interpreting the scope of the appended claims.

Figure 1:
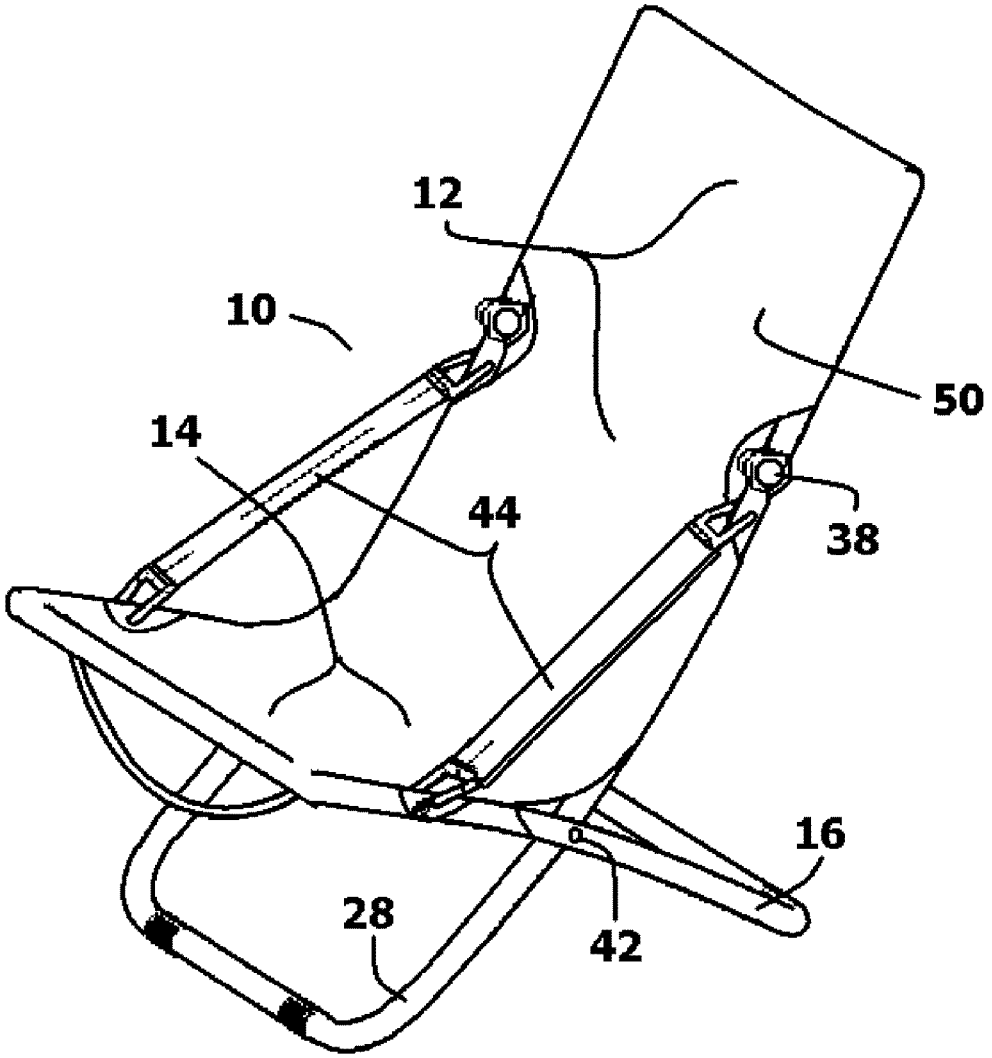
FIG. 1 is a perspective view of an exemplary embodiment of a folding chair assembly in an open configuration.
Figure 2:
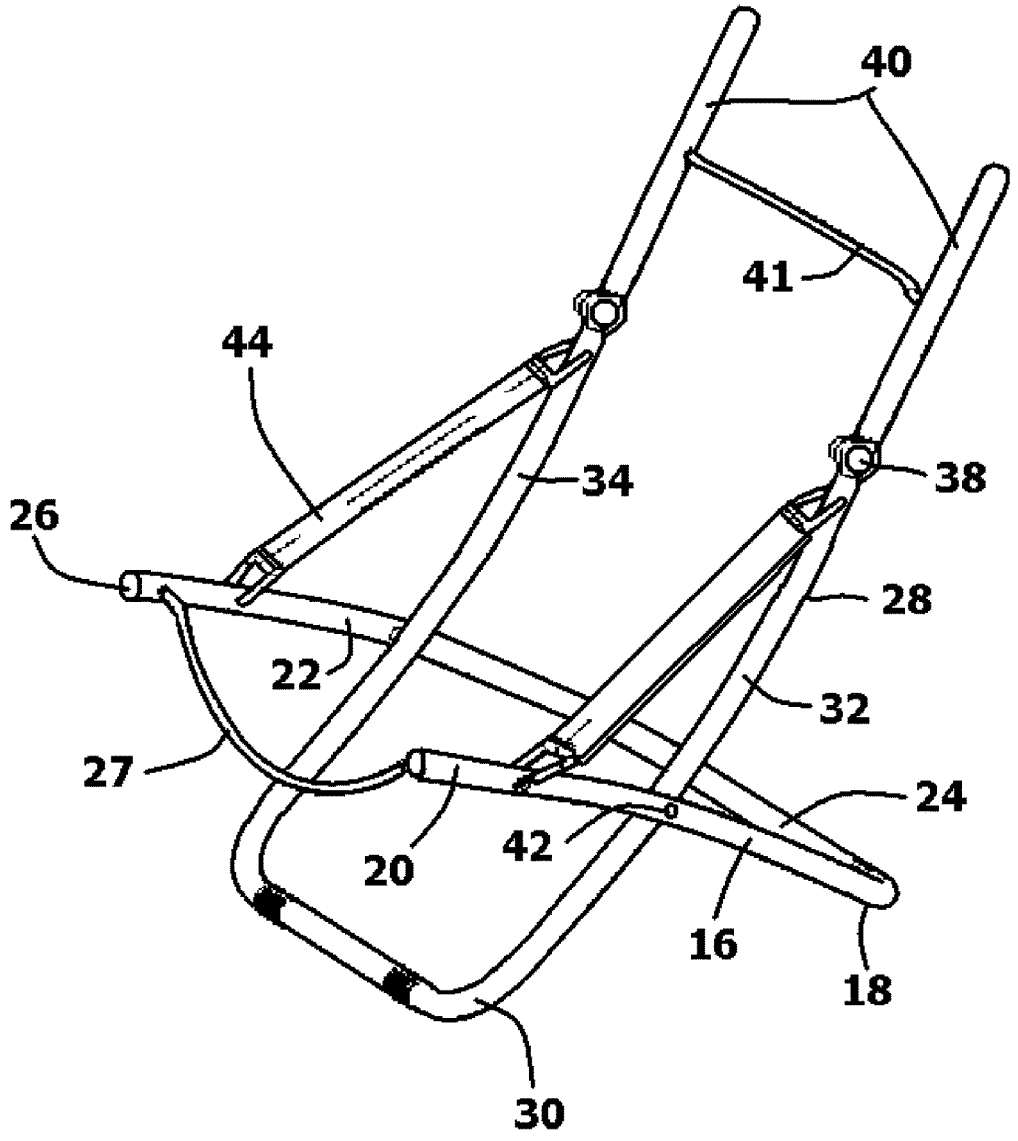
FIG. 2 is a perspective view of the embodiment of FIG. 1 without a fabric seating panel to better show the framework details.
Figure 3:
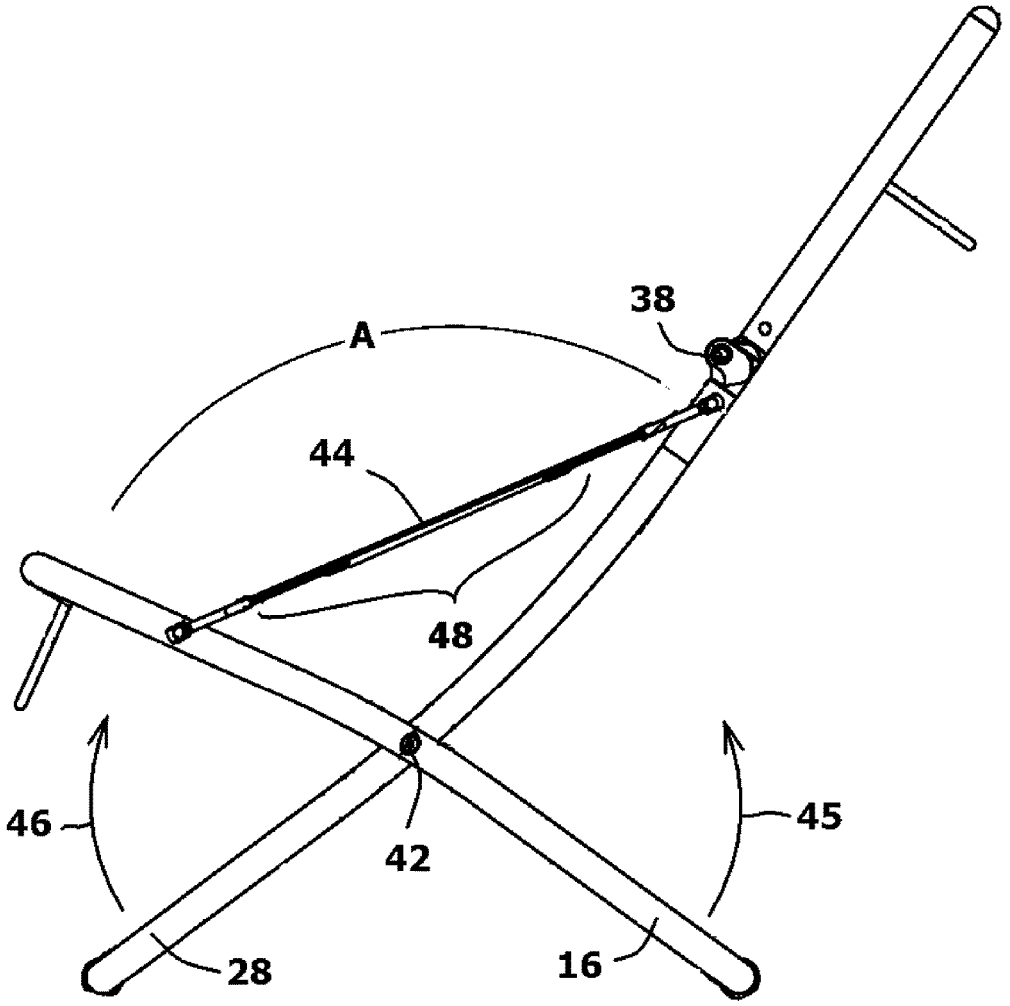
FIG. 3 is a side view showing the embodiment of the folding chair assembly of FIG. 2 in an open configuration.

Referring to both FIG. 1 in conjunction with FIG. 2 and FIG. 3, a folding chair assembly 10 is shown. The folding chair assembly 10 has two primary support sections. The two primary support sections include a backrest support section 12 and a seat support section 14. When the folding chair assembly 10 is in a fully open configuration, a person can sit upon the seat support section 14 and lean against the backrest support section 12.

The seat support section 14 has a seat framework 16 that is fabricated from a first U-shaped framing tube 18. The first U-shaped framing tube 18 has two side frame elements 20, 22 and a cross element 24 that joins the two side frame elements 20, 22 to create the U-shape. It will therefore be understood that each of the side frame elements 20, 22 have free ends 26. The opposite ends of the side frame elements 20, 22 are joined by the cross element 24. An optional spreader element 27 can be set between the side frame elements 20, 22 to ensure the side frame elements 20, 22 remain parallel when a person sits in the folding chair assembly 10.

Likewise, the backrest support section 12 has a backrest framework 28 that is fabricated from a second U-shaped framing tube 30. The second U-shaped framing tube 30 has two side frame elements 32, 34 and a cross element 36 that joins the two side frame elements 32, 34 to create the U-shape. The second U-shaped tube 30 does not have free ends. Rather, each of the side frame elements 32, 34 terminates at a hinge joint 38. The hinge joints 38 connect the side frame elements 32, 34 of the second U-shaped framing tube 30 to a set of side frame extensions 40.

The side frame extensions 40 are two generally straight segments of rigid framing. The side frame extensions 40 can be separate elements, such as is illustrated, or can be interconnected by one or more cross bars. Accordingly, the side frame extensions 40 can be the straight segments of a U-shaped or H-shaped framework. An optional spreader element 41 can be set between the side frame extensions to ensure the side frame extensions 40 remain parallel when a person sits in the folding chair assembly 10.

The first U-shaped framing tube 18 of the seat framework 16 and the second U-shaped framing tube 30 of the backrest framework 28 are joined together to form an X-frame. More particularly, the side frame elements 20, 22 of the seat framework 16 and the side frame elements 32, 34 of the backrest framework 28 are joined together respectively by pivot joints 42. When in an open configuration, the portion of the seat framework 16 below the pivot joints 42 forms the rear legs of the folding chair assembly 10. Likewise, the portion of the backrest framework 28 below the pivot joints 42 forms the front legs of the folding chair assembly 10. Both the seat framework 16 and the backrest framework 28 can rotate freely about the pivot joints 42 in the traditional manner of an X-frame folding chair.

Two armrest straps 44 are provided to prevent the seat framework 16 and the backrest framework 28 from collapsing flat under the force of their own weight. The armrest straps 44 connect the side frame elements 20, 22 of the seat framework 16 to the side frame elements 32, 34 of the backrest framework 28. The armrest straps 44 each have one end that attaches to the seat framework 16 at a point between the pivot joint 42 and the free end 26 of the side frame elements 20, 22. The opposite end of the armrest straps 44 attach to the side frame elements 32, 34 of the backrest framework 28 proximate the hinge joints 38. The armrest straps 44 are sized so they become taught when the folding chair assembly 10 is in an open configuration. The presence of the armrest straps 44 prevents the seat framework 16 and the backrest framework 28 from rotating in the opposing directions of arrow 45 and arrow 46, beyond the optimal open angle (A). (See FIG. 3) The armrest straps 44 are wide and contain a padded section 48 between its two ends. The armrest straps 44 therefore create armrests for the folding chair assembly 10, wherein a person sitting in the folding chair assembly 10 can rest his/her arms upon the padded sections 48 of the armrest straps 44.

In the shown embodiment, it will be understood that a fabric panel 50 is provided. The fabric panel 50 is stretched across the seat framework 16 and the backrest framework 28. The fabric panel 50 creates the seat support section 14 and the backrest support section 12 that contacts and supports the body of a person sitting in the folding chair assembly 10. The fabric panel 50 collapses and folds when the folding chair assembly 10 is manipulated into its folded configuration.

Figure 4:
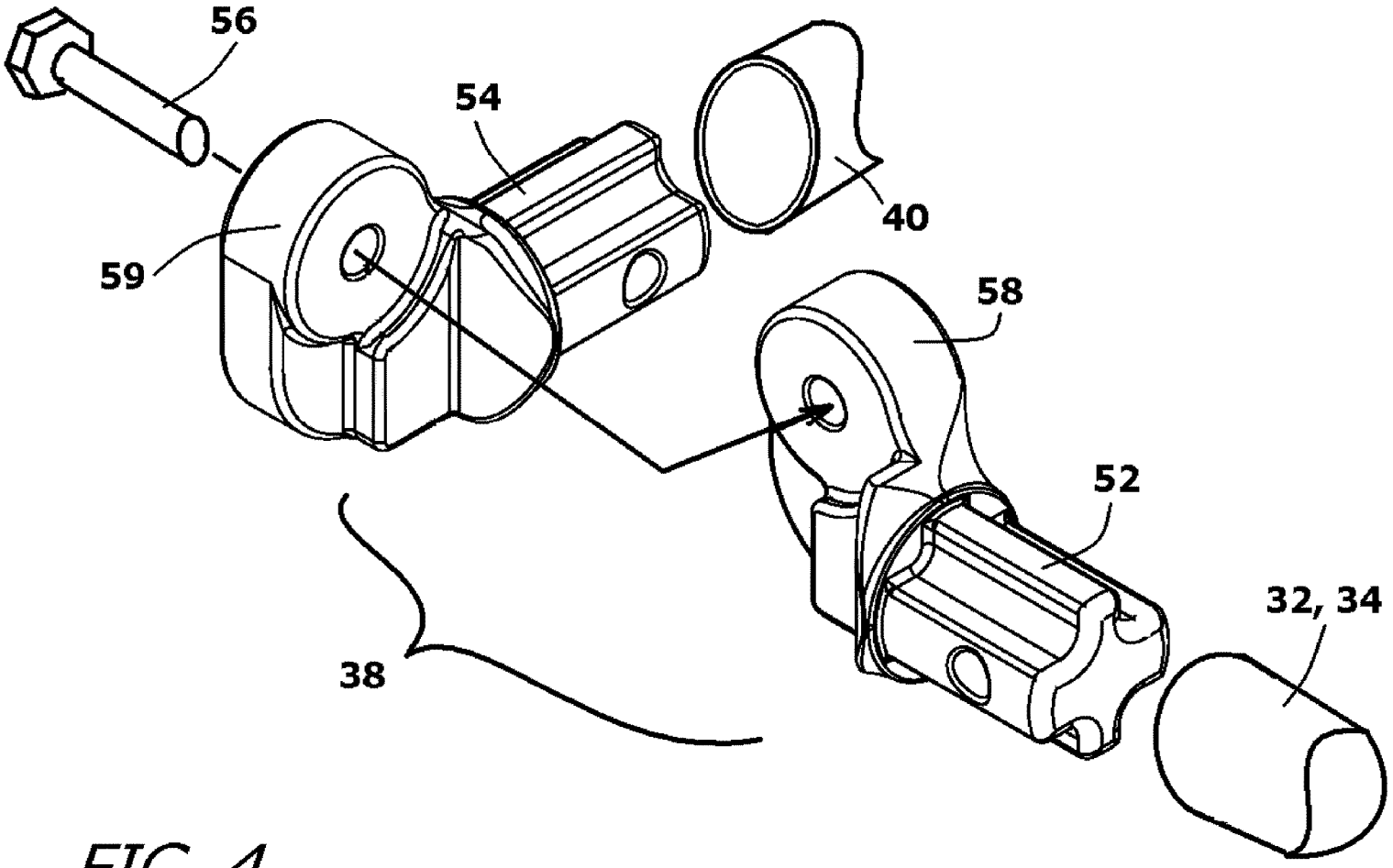
FIG. 4 is an enlarged view of the hinge joint components of the folding chair assembly.
Figure 5:
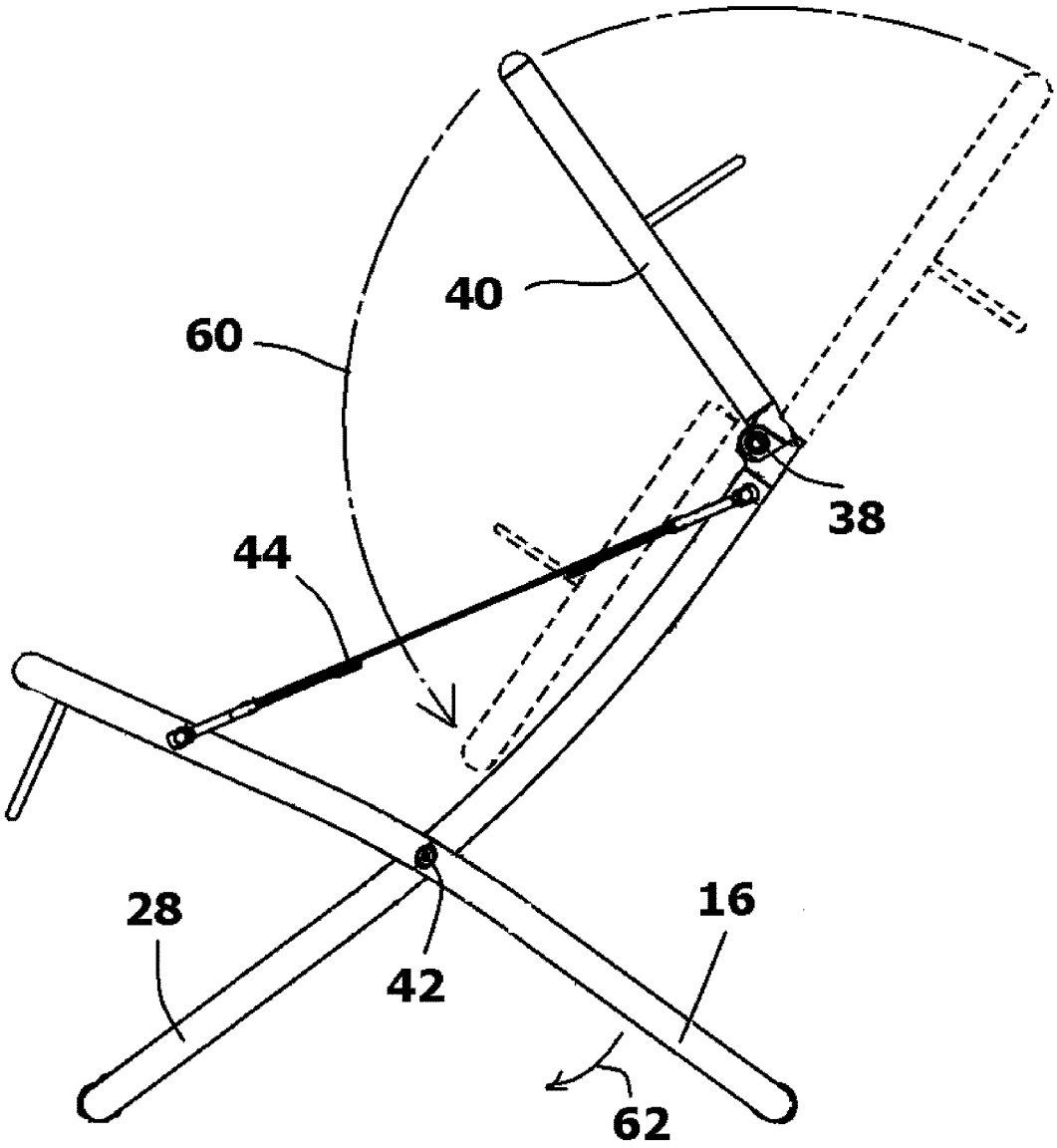
FIG. 5 is a side view showing the exemplary embodiment of the folding chair assembly in a partially folded configuration.

Referring to FIG. 4 and FIG. 5 in conjunction with FIG. 2, it can be seen that each of the hinge joints 38 has a first arm 52 that mounts to the side frame elements 32, 34 of the backrest framework 28 and a second arm 54 that mounts to the side frame extensions 40. The first arm 52 and the second arm 54 are connected by a hinge pin 56 that enables each arm 52, 54 to rotate relative to the other in a common plane. However, the range of rotation is limited. Each arm 52, 54 has a cam head 58, 59 that locks when the arms 52, 54 are linearly aligned. When the arms 52, 54 are linearly aligned, the side frame elements 32, 34 of the backrest framework 28 are linearly aligned with the side frame extensions 40. However, the cam heads 58, 59 enable the side frame extensions 40 to move in the direction of arrow 60 and fold into abutment with the backrest framework 28.

Figure 6:
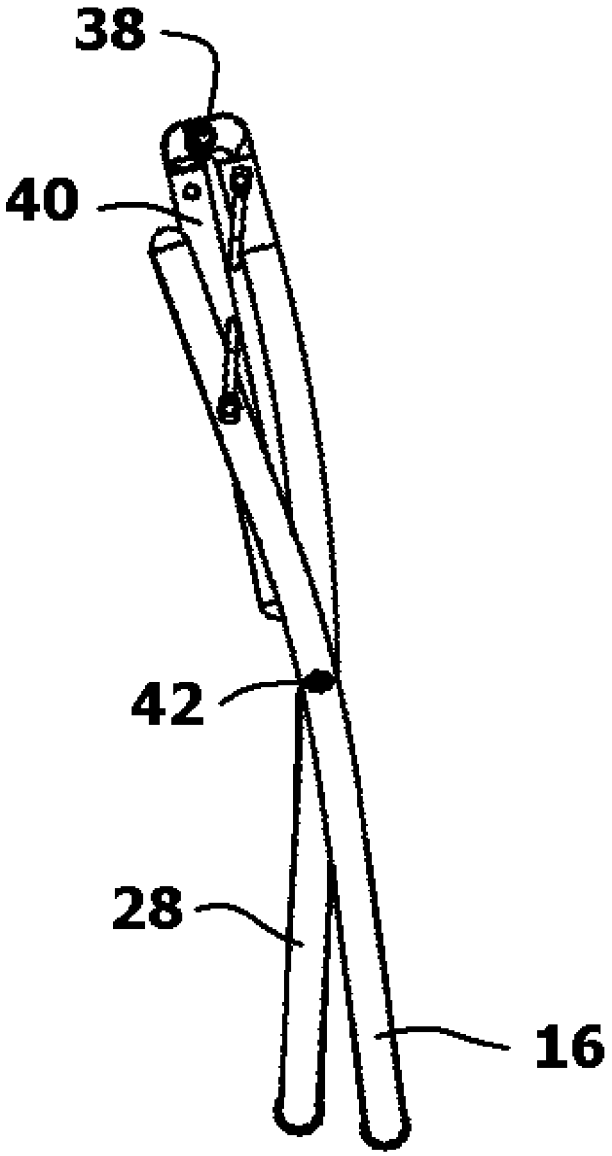
FIG. 6 is a side view showing the exemplary embodiment of the folding chair assembly in a fully folded configuration.

Referring now to FIG. 5 and FIG. 6 in conjunction with FIG. 2 and FIG. 4, it will be understood that in order to close the folding chair assembly 10, the side frame extensions 40 are rotated about the hinge joints 38 until the side frame extension 40 abut against the backrest framework 28. The seat framework 16 is then folded in the direction of arrow 62 around the pivot joints 42. This places the armrest straps 44 into compression, wherein the armrest straps 44 fold and buckle. The seat framework 16 is rotated about the pivot joints 42 until the seat framework 16 is at, or near, the plane of the backrest framework 28. Once the folding chair assembly 10 is fully folded, the seat framework 16, the backrest framework 28 and the side frame extensions 40 are in parallel planes causing both the length and the thickness of the folding chair assembly 10 to be at a minimum.

Figure 7:
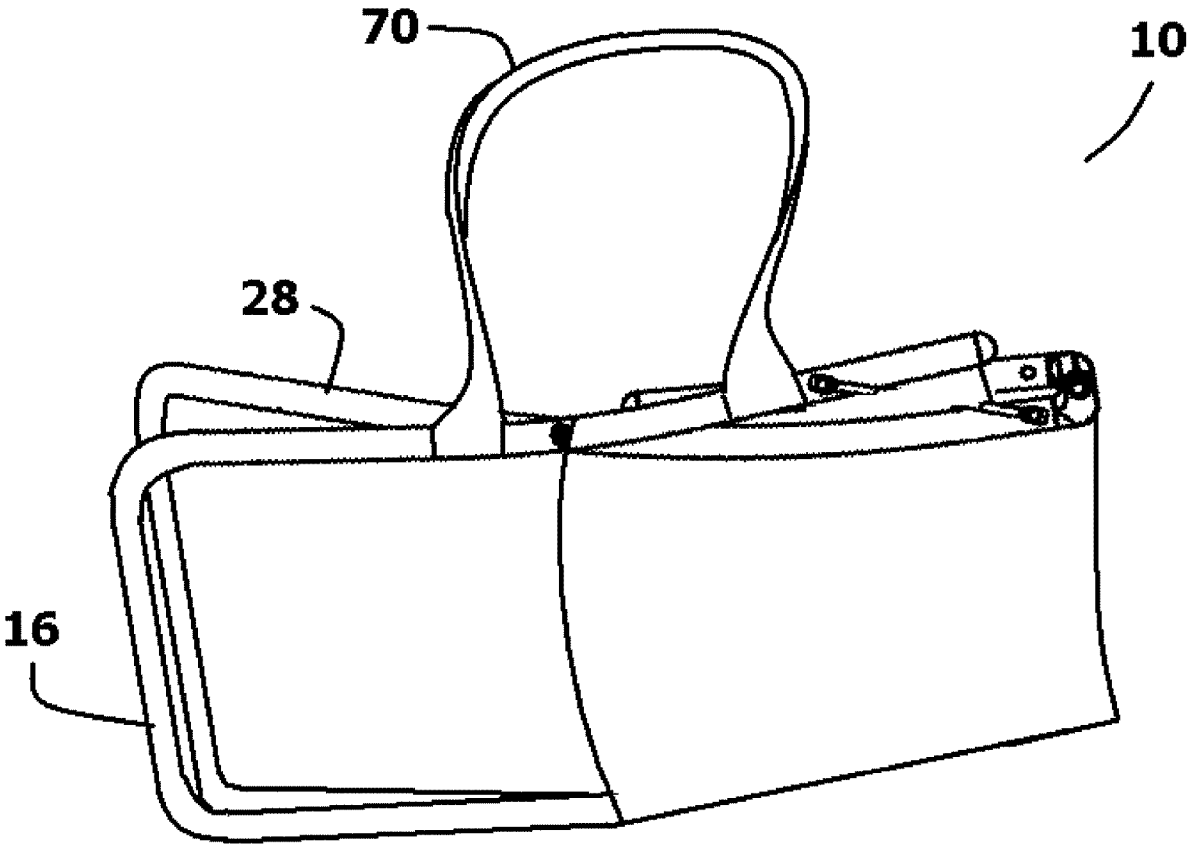
FIG. 7 shows the folding chair assembly in a fully folded configuration hanging from a shoulder strap.

Referring to FIG. 7, it will be understood that a shoulder strap 70 or other carrying device can be attached to the folding chair assembly 10. The shortened length of the folded chair assembly makes it easier to maneuver while it hangs from the shoulder strap 70. The shorter length also makes the folding chair assembly 10 much easier to store in a truck or storage compartment of a compact car.

Figure 8:
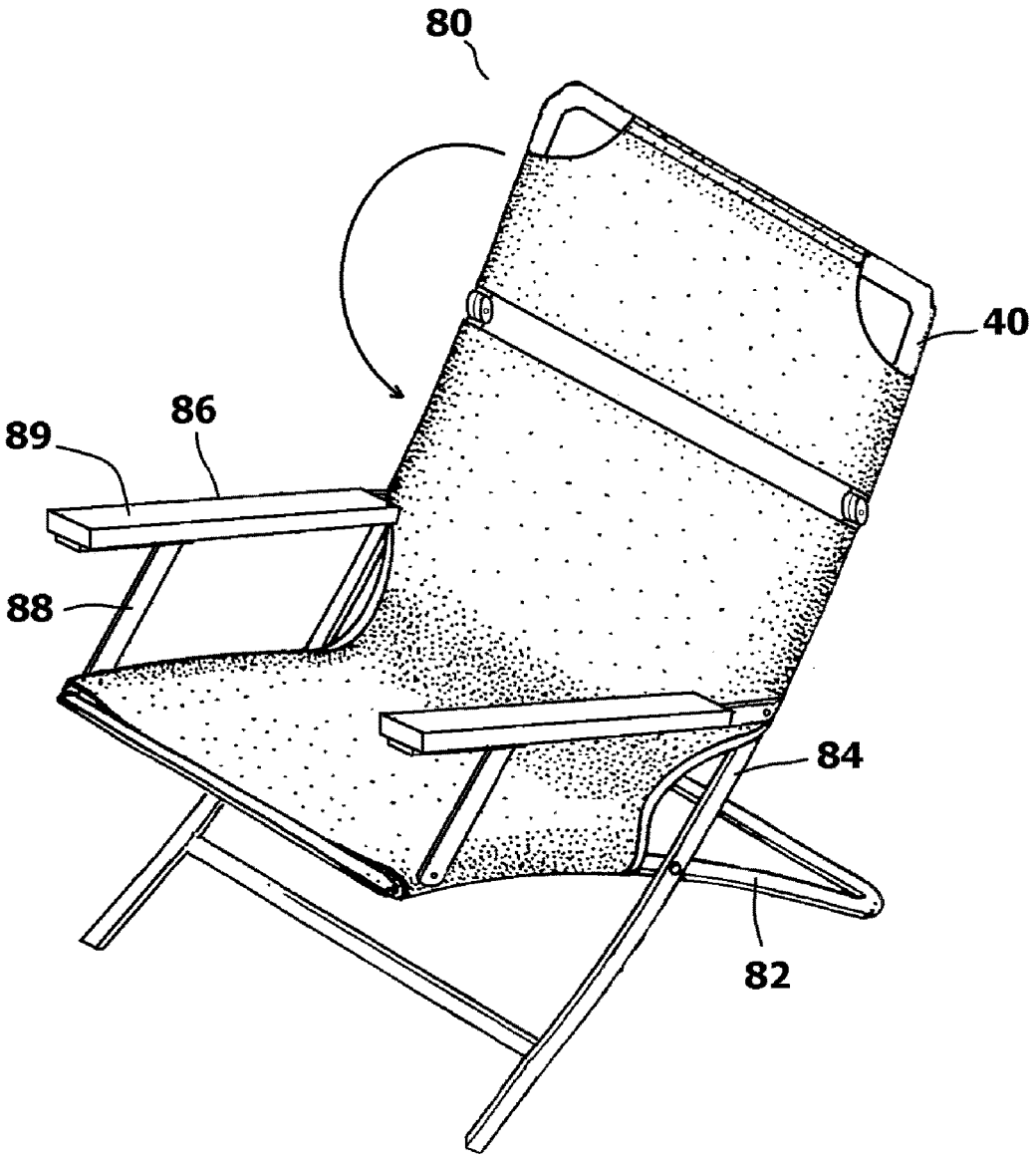
FIG. 8 shows an alternate exemplary embodiment of a folding chair assembly in an open configuration.

Referring to FIG. 8, an alternate embodiment of a folding chair assembly 80 is shown. In this embodiment, a seat framework 82 and a backrest framework 84 are joined together in an X-frame. The X-frame is held in an open configuration by armrest assemblies 86. The armrest assemblies 86 are made of a rigid armrest 89 and a linkage 88 that is connected to the bottom of the armrest 90. The rigid armrest 89 connects to the backrest framework 84. The linkage 88 attaches to the seat framework 82. When the folding chair assembly is fully open, the linkage 88 is fully extended, wherein the armrest assemblies 86 hold the folding assembly 80 open. When the folding chair assembly 80 is closed, the armrest assemblies 86 fold flat into the plane of the closed chair.

The folding chair assembly 80 has a side frame extensions 40 that can fold at hinge joints 38 in the manner previously explained. Accordingly, the folding chair assembly 80 can fold into a compact configuration that is easy to carry.

Figure 9:
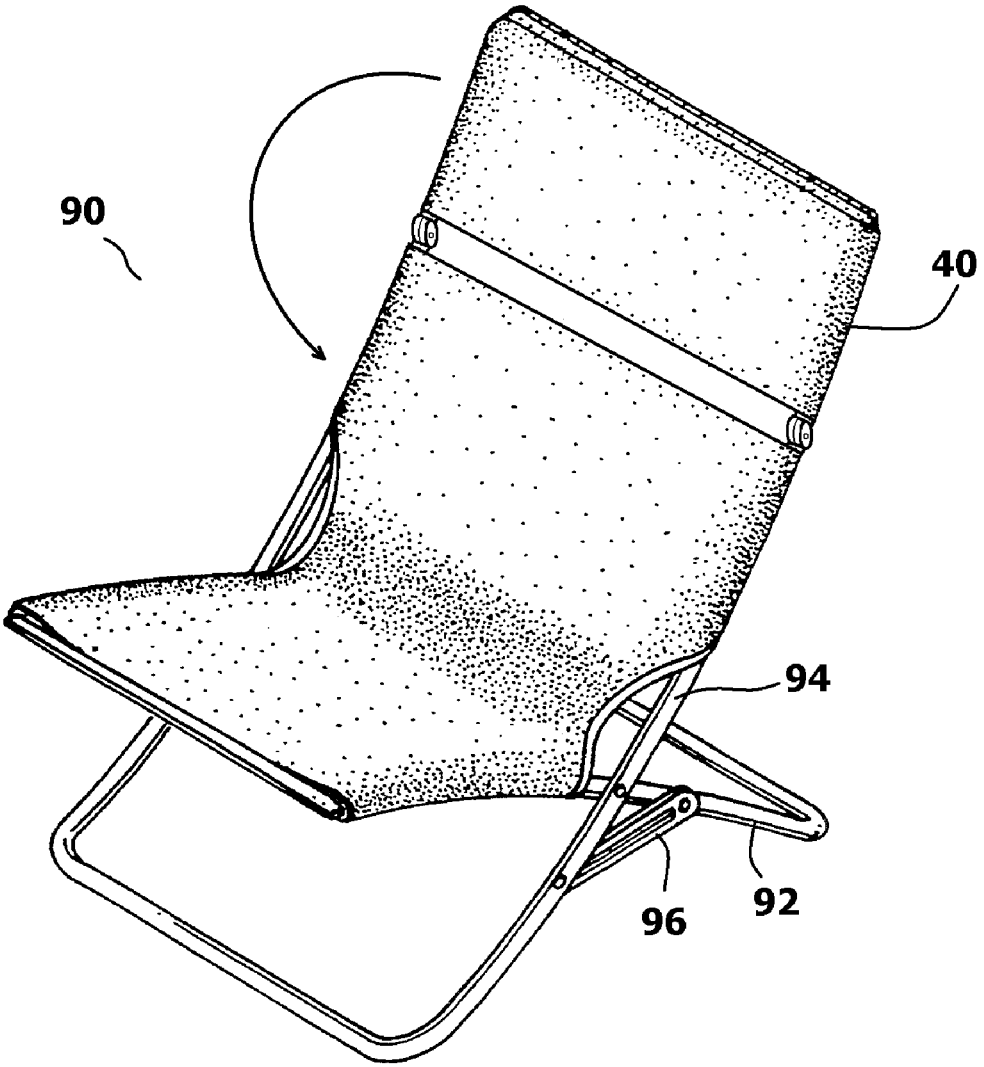
FIG. 9 shows an alternate exemplary embodiment of a folding chair assembly in an open configuration.

Referring to FIG. 9, an alternate embodiment of a folding chair assembly 90 is shown. In this embodiment, a seat framework 92 and a backrest framework 94 are joined together in an X-frame. The X-frame is held in an open configuration by a leg lock mechanism 96. No armrest assemblies are provided.

The folding chair assembly 90 has a side frame extensions 40 that can fold at hinge joints 38 in the manner previously explained. Accordingly, the folding chair assembly 90 can fold into a compact configuration that is easy to carry.

It will be understood that the embodiments of the present invention being illustrated are merely exemplary and that a person skilled in the art can make many variations to those embodiments. For example, the length, width and height of the folding chair assembly can be varied as desired. Likewise, the U-shaped frames can be replaced with H-shaped frames or any other frame shape that can be used on an X-frame chair. All such variations and alternate embodiments are intended to be included within the scope of the claims.

What is claimed is:

1. A folding chair assembly, comprising:

an X-frame having a seat framework joined to a backrest framework at pivot joints, wherein said seat framework and said backrest framework can move about said pivot joints between an open configuration and a folded configuration and wherein said backrest framework includes two parallel side frame elements that are joined by at least one crossbar, wherein said parallel side frame elements extend to free ends;

hinge joints that terminate said free ends of said parallel side frame elements;

frame extensions that are joined to said parallel side frame elements of said backrest framework with said hinge joints, wherein said hinge joints enable said frame extensions to be folded about said hinge joints between a first position, where said frame extensions abut against said backrest framework, and a second position, where said frame extensions are linearly aligned with said parallel side frame elements of said backrest framework and elongate said backrest framework; and at least one foldable panel supported by said seat framework, said backrest framework and said extensions to create a seat support surface and a backrest support surface.

2. The assembly according to claim 1, further including straps that extend between said seat framework and said backrest framework, wherein said straps are taut in tension when said seat framework and said backrest framework are in said open configuration.

3. The assembly according to claim 1, wherein said frame extensions are straight frame extensions.

4. The assembly according to claim 2, wherein said straps have padded sections that create armrests between said seat framework and said backrest framework, when said seat framework and said backrest framework are in said open configuration.

5. The assembly according to claim 1, wherein said parallel side frame elements of said backrest framework are parts of a U-shaped framing tube.

6. The assembly according to claim 5, wherein said seat framework is configured as a second U-shaped framing tube.

7. A folding chair assembly, comprising:

a seat framework;

a U-shaped backrest framework having two parallel side frame elements with free ends, wherein said parallel side frame elements are joined to said seat framework at pivot joints, wherein said seat framework and said U-shaped backrest framework can move about said pivot joints between an open configuration and a folded configuration;

straps that extend between said seat framework and said U-shaped backrest framework, wherein said straps are taut in tension when said seat framework and said U-shaped backrest framework are in said open configuration;

frame extensions;

hinge joints, wherein each of said hinge joints has a first arm, a second arm and cam heads, wherein said cam heads are joined by a hinge pin, and said cam heads are shaped to prevent said first arm and said second arm from rotating about said hinge pin beyond a linear orientation;

wherein said first arm on each of said hinge joints terminate said free ends of said parallel side frame elements of said U-shaped backrest framework;

wherein said second arm on each of said hinge joints mounts into said frame extensions;

wherein said hinge joints enable said frame extensions to be folded about said hinge joints between a first position, where said frame extensions abut against said U-shaped backrest framework, and a second position, where said frame extensions are linearly aligned with said parallel side frame elements of said U-shaped backrest framework; and at least one foldable panel supported by said seat framework, said U-shaped backrest framework and said frame extensions.

8. The assembly according to claim 7, wherein said straps have padded sections that create armrests between said seat framework and said U-shaped backrest framework, when said seat framework and said U-shaped backrest framework are in said open configuration.

9. The assembly according to claim 7, wherein said parallel side frame elements are joined by at least one crossbar.

10. The assembly according to claim 9, wherein said seat framework is configured as a U-shaped framing tube.

* * * * *